US012379183B2

(12) United States Patent
Henderson

(10) Patent No.: US 12,379,183 B2
(45) Date of Patent: Aug. 5, 2025

(54) ANGLED SUPPORT GRIP FOR FIREARMS

(71) Applicant: David F. Henderson, Las Vegas, NV (US)

(72) Inventor: David F. Henderson, Las Vegas, NV (US)

( * ) Notice: Subject to any disclaimer, the term of this patent is extended or adjusted under 35 U.S.C. 154(b) by 45 days.

(21) Appl. No.: 18/200,323

(22) Filed: May 22, 2023

(65) Prior Publication Data

US 2024/0142195 A1 May 2, 2024

Related U.S. Application Data

(60) Provisional application No. 63/421,292, filed on Nov. 1, 2022.

(51) Int. Cl.
*F41C 23/16* (2006.01)
*F41C 27/00* (2006.01)
*F41G 1/35* (2006.01)

(52) U.S. Cl.
CPC ..... *F41C 23/16* (2013.01); *F41C 27/00* (2013.01); *F41G 1/35* (2013.01)

(58) Field of Classification Search
CPC ..... F41C 23/16; F41C 27/00; F41G 1/35
USPC ..... 42/71.01
See application file for complete search history.

(56) References Cited

U.S. PATENT DOCUMENTS 1,695,071 A 12/1928 Villalpando
2,056,975 A 10/1936 Charles, Jr.
3,758,978 A 9/1973 Theodore
3,782,019 A * 1/1974 Venturini ..... F41C 23/12 42/72
4,271,623 A 6/1981 Beretta
4,735,007 A 4/1988 Gal
4,878,305 A * 11/1989 Gabrielidis ..... F41A 19/09 42/118

(Continued)

FOREIGN PATENT DOCUMENTS

WO WO-2005047801 A2 * 5/2005 ..... F41A 33/04
WO 2018215625 A1 11/2018

OTHER PUBLICATIONS

UTG Ultra Slim Angled M-LOK Foregrip, Matte Black, https://www.80-lower.com/products/utg-ultra-slim-angled-m-lok-foregrip-matte-black/ (Sep. 2020).

*Primary Examiner* — Troy Chambers
*Assistant Examiner* — Benjamin S Gomberg
(74) *Attorney, Agent, or Firm* — DICKINSON WRIGHT PLLC

(57) ABSTRACT

An angled support grip for a firearm, such as a long gun, includes an upper portion configured to attach to the frame of the firearm beneath the barrel and forward of the trigger guard; and a forward support extending downward from an end of the upper portion opposite from the trigger guard. The angled support grip also includes an angled handle configured to be gripped by a hand of a user and attached to the forward support at a lower end thereof, opposite from the upper portion, the angled handle extending upward and rearward toward the upper portion along a length thereof away from the forward support. A flashlight head attaches to a forward face of the forward support to project light toward a target. The angled handle is selectively removable from the angled support grip and attachable directly to the flashlight head to form a flashlight assembly.

18 Claims, 5 Drawing Sheets

(56) References Cited

U.S. PATENT DOCUMENTS 6,226,915 B1 5/2001 Kotsiopoulos
6,658,781 B1 12/2003 Bowen
6,698,127 B2 3/2004 Weber
7,264,369 B1 * 9/2007 Howe ..... F41G 1/35 362/205
8,117,782 B2 2/2012 Gross
8,707,604 B2 * 4/2014 Troy ..... F41C 23/16 42/72
8,757,040 B1 6/2014 Galloway
9,062,933 B1 * 6/2015 Allen ..... F41G 1/35
9,194,649 B2 11/2015 Nierenberg
9,194,651 B2 11/2015 Nierenberg
9,354,012 B2 5/2016 Faifer
D785,744 S 5/2017 Bosco
9,891,020 B2 * 2/2018 Jen ..... F41C 23/16
10,066,900 B2 9/2018 Bowers
10,782,092 B2 9/2020 Miller
11,118,859 B1 * 9/2021 Hawk ..... F41C 23/16
11,549,780 B1 1/2023 Henderson
2005/0011101 A1 * 1/2005 Gooder ..... F41C 23/14 42/71.01
2008/0209789 A1 9/2008 Oz
2009/0122527 A1 * 5/2009 Galli ..... F41G 11/003 362/110
2011/0107643 A1 * 5/2011 Fitzpatrick ..... F41C 23/16 42/72
2011/0167707 A1 * 7/2011 Gross ..... F41C 23/16 42/114
2011/0185617 A1 * 8/2011 Brixius ..... F41C 23/16 42/71.01
2013/0036646 A1 * 2/2013 Rubac ..... F41C 23/22 42/90
2014/0059911 A1 * 3/2014 Oh ..... F41C 23/16 42/114
2014/0196342 A1 * 7/2014 Syrengelas ..... F41C 7/02 156/60
2015/0233668 A1 * 8/2015 Moore ..... F41G 1/35 42/72
2016/0061560 A1 * 3/2016 Saadon ..... F41G 1/35 42/72
2016/0146573 A1 5/2016 Kunkel
2019/0145730 A1 * 5/2019 Chavez ..... F41C 23/16 42/71.01
2019/0162505 A1 * 5/2019 Mezynski ..... F41C 27/00
2019/0242674 A1 * 8/2019 Berean ..... F41G 11/003
2019/0249969 A1 * 8/2019 Griffith ..... F41A 17/38
2019/0390935 A1 * 12/2019 Purkiss ..... F41C 23/16
2020/0011636 A1 * 1/2020 Jen ..... F41C 33/007
2020/0278172 A1 * 9/2020 Schrock ..... F41C 7/00
2021/0116211 A1 * 4/2021 Underwood ..... F41C 23/16
2021/0270573 A1 * 9/2021 Verjovsky ..... F41C 23/22
2021/0278168 A1 * 9/2021 Mantas ..... F41A 23/06
2022/0364822 A1 * 11/2022 Weinberger ..... F41C 27/00
2023/0013076 A1 * 1/2023 Henderson ..... F41C 23/12
2023/0081853 A1 * 3/2023 Butler ..... F41C 27/00 42/72
2023/0175814 A1 * 6/2023 Meissen ..... F41C 23/16 362/11

* cited by examiner

ANGLED SUPPORT GRIP FOR FIREARMS

CROSS REFERENCE TO RELATED APPLICATIONS

This U.S. utility patent application claims the benefit of U.S. Provisional Patent Application No. 63/421,292 titled "ANGLED SUPPORT GRIP FOR FIREARMS" and filed Nov. 1, 2022, the contents of which is incorporated herein by reference in its entirety.

FIELD

The present disclosure relates generally to accessories for firearms, such as long guns. More specifically, the present disclosure relates to an angled support grip for holding a firearm at a position forward of its trigger.

BACKGROUND

Many different handgrips exist for holding firearms, such as pistols and rifles. Long guns, such as rifles and shotguns, typically use a forward handgrip located forward of the trigger for supporting the firearm with the non-shooting hand holding the barrel in a cradle position.

SUMMARY

The present disclosure provides an angled support grip for holding a firearm, such as a long gun. The angled support grip of the present disclosure may provide several advantages over conventional firearm grips. Use of the angled support grip of the present disclosure may provide a compact stance that reduces the cross-sectional area of the user. The angled support grip may also reduce fatigue and barrel flip, allowing a user to have improved control, and/or reduced time to come back to target after firing one or more shots.

The present disclosure also provides an angled support grip for a firearm having a frame, a trigger guard, and a barrel. The angled support grip comprises: an upper portion configured to attach to the frame of the firearm beneath the barrel and forward of the trigger guard; and a forward support extending downward from an end of the upper portion opposite from the trigger guard. The angled support grip also comprises an angled handle configured to be gripped by a hand of a user and attached to the forward support at a lower end thereof, opposite from the upper portion, the angled handle extending upward and rearward toward the upper portion along a length thereof away from the forward support.

The present disclosure also provides an angled support grip for a firearm having a frame, a trigger guard, and a barrel. The angled support grip comprises: an upper portion configured to attach to the frame of the firearm beneath the barrel and forward of the trigger guard; and a forward support extending downward from an end of the upper portion opposite from the trigger guard; and angled extension extending downward and rearward from an end of the forward support, opposite from the upper portion. The angled support grip also comprises an angled handle configured to be gripped by a hand of a user and attached to the angled extension, the angled handle extending upward and rearward toward the upper portion along a length thereof away from the angled extension.

The present disclosure also provides an angled support grip for a firearm having a frame, a trigger guard, and a barrel. The angled support grip comprises: an upper portion configured to attach to the frame of the firearm beneath the barrel and forward of the trigger guard; a forward support extending downward from the upper portion, away from the barrel; an angled handle configured to be gripped by a hand of a user and attached to the forward support at a lower end thereof, opposite from the upper portion, the angled handle extending upward and rearward toward the trigger guard along a length thereof away from the forward support; and a flashlight head having one or more illumination sources and attached to a forward face of the forward support to project light toward a target. The angled handle is selectively removable from the forward support and the flashlight head is selectively removable from the forward support. The angled handle is selectively attachable directly to the flashlight head to form a flashlight assembly.

The present disclosure also provides an angled support grip for a firearm having a frame, a trigger guard, and a barrel. The angled support grip comprises: an upper portion configured to attach to the frame of the firearm beneath the barrel and forward of the trigger guard; and a forward support extending downward from an end of the upper portion opposite from the trigger guard; a threaded receiver to which is attached a threaded handle or the rear portion of a battery powered illumination source, to include a laser or a camera, extending downward and rearward from an end of the forward support, opposite from the upper portion. The angled support grip also provides a threaded mount capable of accepting the mounting of the forward portion of a battery powered illumination source, to include a laser or camera. The angled support grip also includes internal wiring to provide electrical connection between the two components of the battery powered illumination source. The item inserted into the threaded receiver is configured to serve as an angled handle to be gripped by a hand of a user as attached to the angled extension, angled handle extending upward and rearward toward the upper portion along a length thereof away from the angled extension.

BRIEF DESCRIPTION OF THE DRAWINGS

Further details, features and advantages of designs of the invention result from the following description of embodiment examples in reference to the associated drawings.

DETAILED DESCRIPTION

Figure 1:
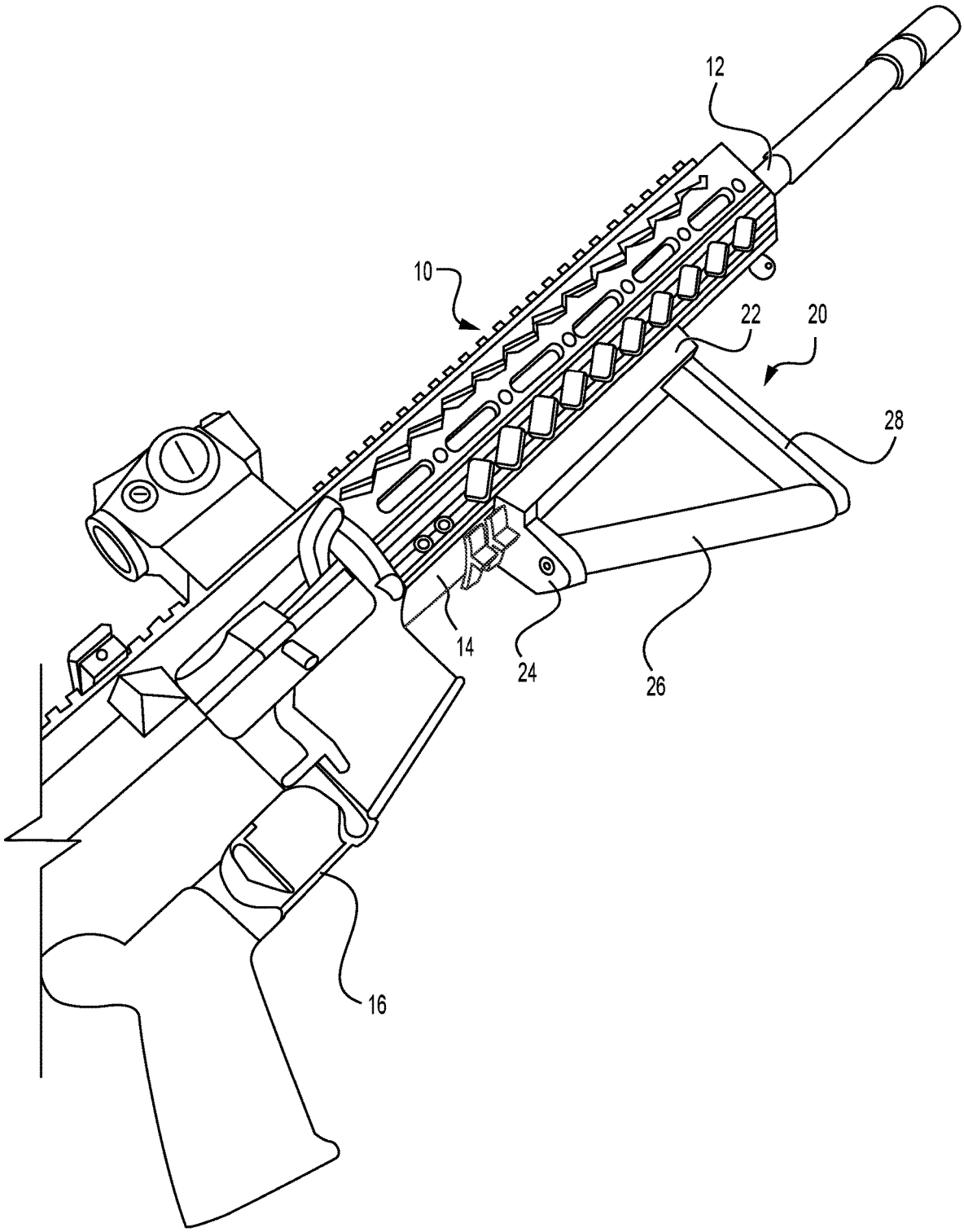
FIG. 1 shows a first angled support grip in accordance with the present disclosure, and attached to a rifle.

Referring to the drawings, the present invention will be described in detail in view of following embodiments. The present disclosure provides an angled support grip 20, 120, 220, 320 for a firearm, such as a long gun. Example drawings show the angled support grip 20, 120, 220, 320 used with a rifle 10. However, the angled support grip 20, 120, 220, 320 of the present disclosure may be used with any type of long gun, such as a rifle, shotgun, muzzle loader, etc.

The angled support grip 20, 120, 220, 320 may be made of thermoplastic, such as Acrylonitrile styrene acrylate (ASA). However, the angled support grip 20, 120, 220, 320 may be made of one or more other materials, such as fiber-reinforced plastic, carbon fiber, metal, etc.

FIG. 1 shows a first angled support grip 20, in an installed configuration, attached to a rifle 10. The rifle 10 includes a barrel 12 and a frame 14 that defines a mounting rail, such as a Picatinny rail. The mounting rail may have a generally dovetail shape for receiving a corresponding slot for mounting accessories to the rifle 10.

The first angled support grip 20 includes a first upper portion 22 configured to attach to the frame 14 of a firearm, such as the rifle 10, beneath the barrel 12, and forward of a trigger guard 16. The first angled support grip 20 also includes a rear transverse portion 24 extending downward from the forward end of the first upper portion 22. The first angled support grip 20 also includes a first angled handle 26 that is attached to the first upper portion 22 at the rear transverse portion 24. The first angled handle 26 has a cylindrical shape that extends at a 30-degree angle with respect to an upper surface of the first upper portion 22.

The rifle 10 also includes a trigger guard 16, with the first angled handle 26 angled upward and rearward toward the trigger guard 16. In this way, a user can grip the first angled handle 26 with the non-trigger hand (i.e., the opposite hand from the one operating the trigger in the trigger guard 16), and with the forearm of the non-trigger hand having a natural downward and rearward angle. In this way, the user may support the forearm of the non-trigger hand against the torso or another structure, and with the hand of the non-trigger hand firmly gripping the first angled handle 26 with a closed grip.

In some embodiments, the first angled support grip 20 may be configured such that the first angled handle 26 extends at a 30-degree angle (approximately) to a barrel 12 of a firearm attached thereto. For example, the first angled handle 26 may extend at an angle between 25-degrees and 35-degrees from the barrel 12 of the firearm attached to the first upper portion 22. In some embodiments, and as shown, for example on FIG. 2, the angled support grip may have a C-shape or a hook shape, with the angled handle having an upper end that is free and unsupported (i.e. with the angled handle supported only on a lower end thereof, spaced apart from the upper portion). In such a C-shape configuration, angled handle may still define an angle of 30-degrees, or approximately 30-degrees to the barrel. The 30-degree angle may be a virtual angle between the barrel and a line extending from the angled handle. In other words, and as shown in FIG. 2, a line parallel to an axis of the angled support grip may define a 30-degree angle with the barrel or with another line that is parallel to the barrel, such as a bottom surface of an upper portion 122.

Referring back to FIG. 1, the first angled support grip 20 also includes a first forward support 28 that extends downward from the rear end of the first upper portion 22 opposite from the rear transverse portion 24, and farthest from the trigger guard with the first angled support grip 20 installed on a firearm. The first forward support 28 extends in a straight line and is generally perpendicular to the first upper portion 22. The first forward support 28 attaches to the first angled handle 26 at an end thereof opposite from the rear transverse portion 24. The first forward support 28 defines an internal angle of about approximately 90-degrees relative to the first angled handle 26. Together, the first upper portion 22, the first angled handle 26, and the first forward support 28 define a handle aperture 29 for receiving the hand of a user gripping the first angled handle 26.

In use, the first upper portion 22 is installed on a firearm, beneath and parallel to the barrel, with the rear transverse portion 24 toward the trigger guard of the firearm and the forward support 28 toward the muzzle of the firearm.

Figure 2:
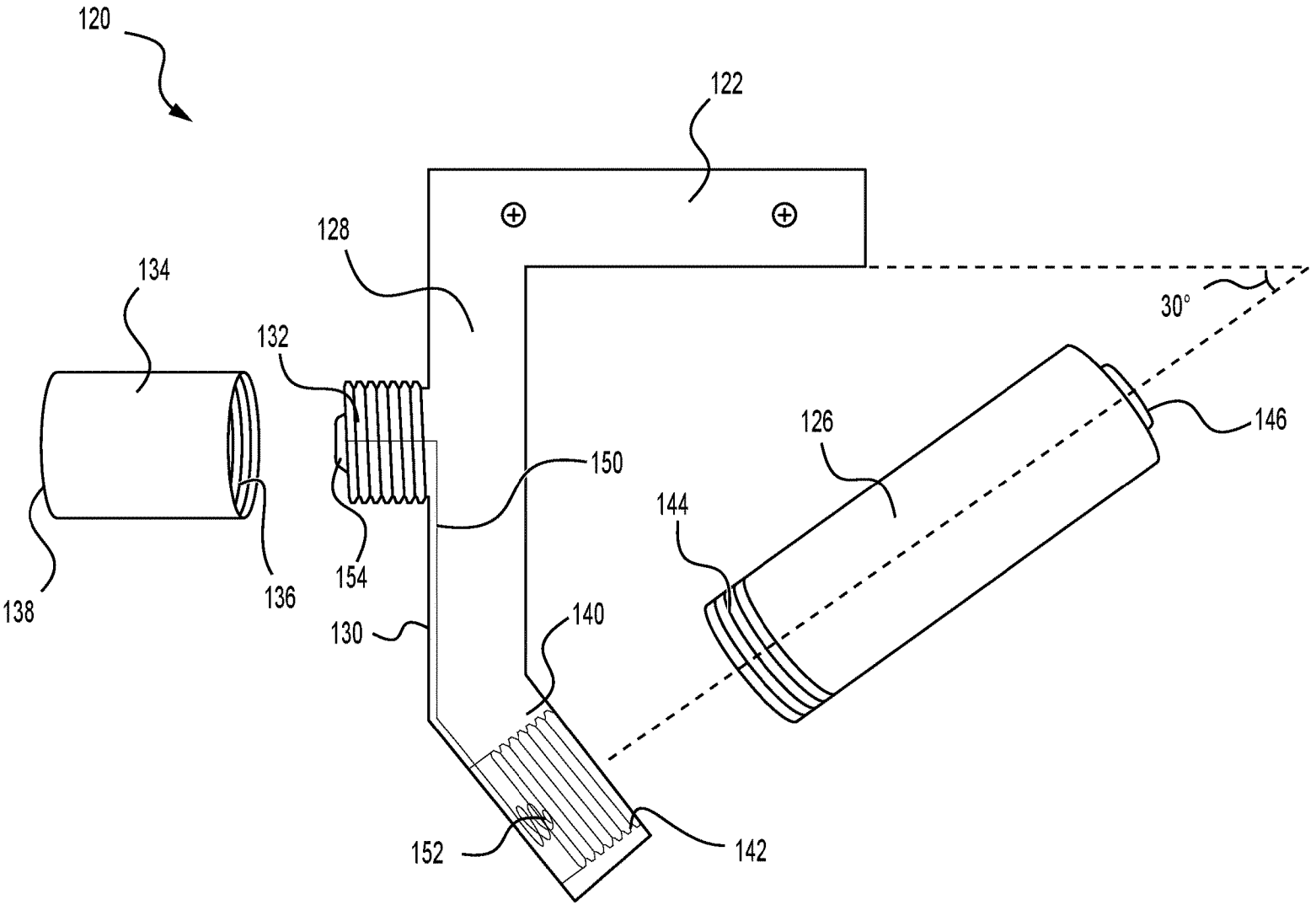
FIG. 2 shows an exploded side view of a second angled support grip, in accordance with an aspect of the present disclosure.

FIG. 2 shows a side view of a second angled support grip 120 of the present disclosure. The second angled support grip 120 may be similar or identical to the first angled support grip 20, except for a few differences described herein.

The second angled support grip 120 includes a second upper portion 122 configured to attach to the frame of a firearm, beneath the barrel and forward of a trigger guard. The second angled support grip 120 also includes a second forward support 128 that extends downward from an end of the second upper portion 122 in a straight line perpendicular to the second upper portion 122.

The second angled support grip 120 also includes a second angled handle 126 having a cylindrical shape that extends upward and rearward at a 60-degree angle from the bottom of the second forward support 128. Thus, the second angled handle 126 may define the same 30-degree angle to the barrel of a firearm. Unlike the first angled support grip 20, the end of the second angled handle 126 opposite from the second forward support 128 is not connected to the second upper portion 122. Instead, the second angled handle 126 is supported only on the lower/forward end thereof. The second angled handle 126 is connected to the second forward support 128 by a first angled extension 140 located at the bottom of the second forward support 128, opposite from the second upper portion 122.

The first angled extension 140 extends downward and rearward at an 150-degree angle from the end of the second forward support 128, opposite from the second upper portion 122. The second angled handle 126 extends perpendicularly from the first angled extension 140. The first angled extension 140 defines a first socket 142 having internal threads for engaging corresponding a first external thread 144 on an end of the second angled handle 126, thereby providing for the second angled handle 126 to be removably attached to the second forward support 128.

The second forward support 128 of the second angled support grip 120 defines a second forward face 130 that faces away from the second angled handle 126 and away from the user. The second forward face 130, therefore, faces toward a target direction of the firearm when the second angled support grip 120 is installed on the firearm. A first flashlight mount 132 is disposed on the second forward face 130 of the second forward support 128 of the second angled support grip 120, approximately mid-way between the second upper portion 122 and the first angled extension 140. The first flashlight mount 132 is configured to hold and to provide power to a first flashlight head 134 having one or more illumination sources, such as LEDs.

The first flashlight mount 132 may include first external threads (i.e., male threads) configured to engage corresponding first internal threads 136 of the first flashlight head 134. The first flashlight head 134 defines a lens and internal circuitry 138 that faces away from the second forward support 128 to project light toward a target when the second angled support grip 120 is mounted on a firearm.

The second angled handle 126 may also function as a flashlight body, with a tubular construction holding one or more batteries therein. In some embodiments, the flashlight body that functions as the second angled handle 126 and the first flashlight head 134 may be parts of a commercially-available flashlight product. A first switch 146 is located on an end of the second angled handle 126 (i.e., the flashlight body) opposite from the first angled extension 140, and immediately below the thumb of a hand gripping the second angled handle 126. The first switch 146 may selectively enable the first flashlight head 134. In some embodiments, the first switch 146 may cycle between several different modes for operating one or more illumination sources in the first flashlight head 134.

The first flashlight head 134 may be selectively removable from the second angled support grip 120 and selectively attachable directly to the second angled handle 126 (i.e., without the second forward support 128 therebetween) to form a flashlight assembly (not shown in the FIGS.). For example, the first flashlight head 134 may screw onto each of the first flashlight mount 132 and the first external thread 144 of the second angled handle 126. Other connection mechanisms, such as a bayonet fitting, may be used instead of screw threads.

The second angled support grip 120 further includes a first electrical conductor 150, which may include one or more wires, for providing an electrical connection between the second angled handle 126 (i.e., the flashlight body) and the first flashlight head 134. In some embodiments, the first electrical conductor 150 may include a single wire connecting a first electrical contact 152 at a base of the first socket 142 with a second electrical contact 154 on the first flashlight mount 132. Metal forming the second angled handle 126, the second forward support 128, and the first angled extension 140 may function as another conductor in an electrical circuit between the second angled handle 126 and the first flashlight head 134.

The second angled handle 126 of the second angled support grip 120 may include a hollow tube, such as a tube of Aluminum, and containing one or more batteries for powering the illumination source in the first flashlight head 134. The batteries may include 18650 size lithium batteries, although other types and sizes of batteries may be used.

The second upper portion 122 includes a Picatinny rail mount, which is configured to engage a corresponding Picatinny rail on the frame 14 of the rifle 10. The Picatinny rail mount may include a locking mechanism (not shown in the Figures), such as a cam-based or tool-less locking mechanism and/or one or more screws or other fasteners configured to secure the Picatinny rail mount of the second upper portion 122 with the corresponding Picatinny rail of the rifle 10.

Figure 3:
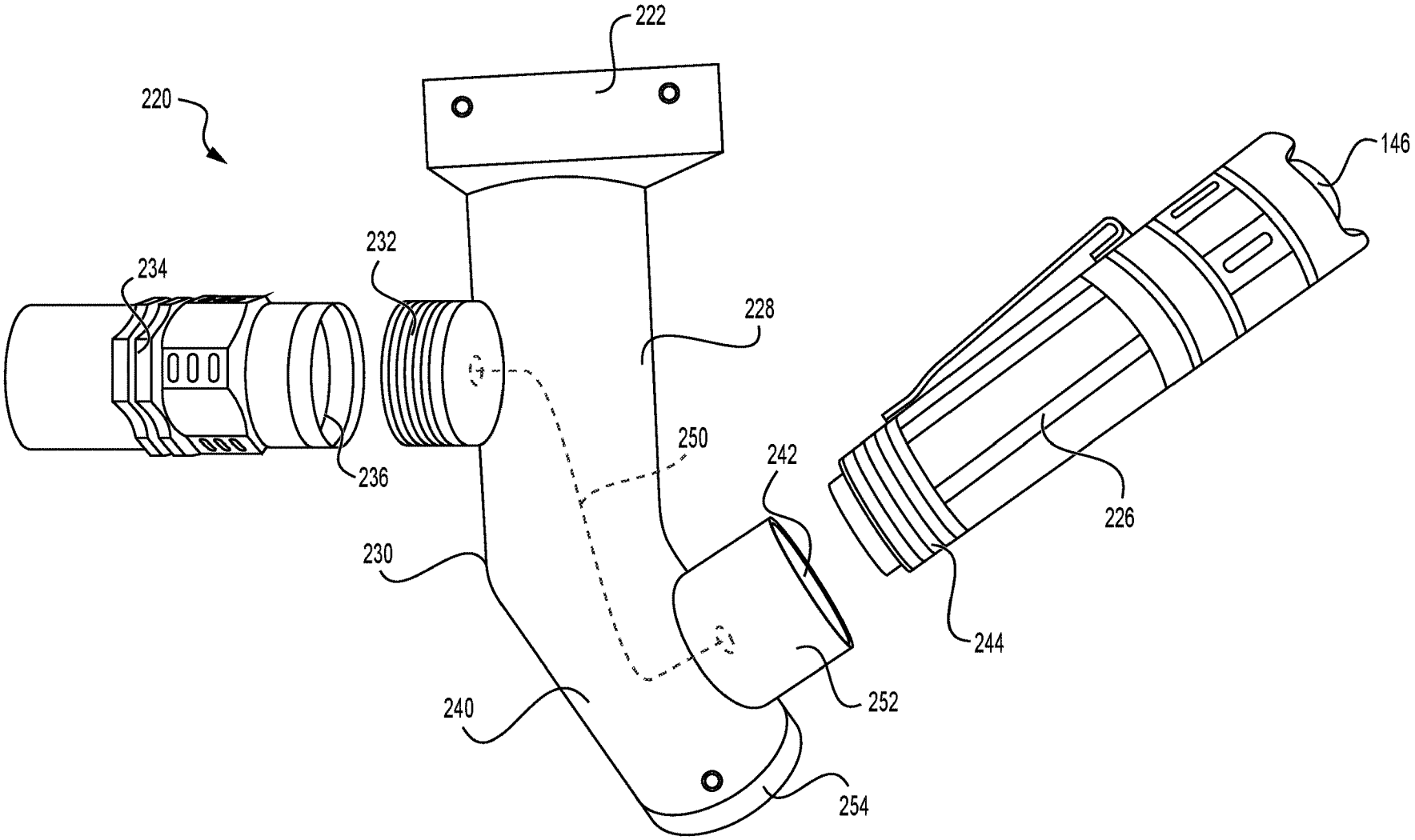
FIG. 3 shows an exploded side view of a third angled support grip, in accordance with an aspect of the present disclosure.
Figure 4:
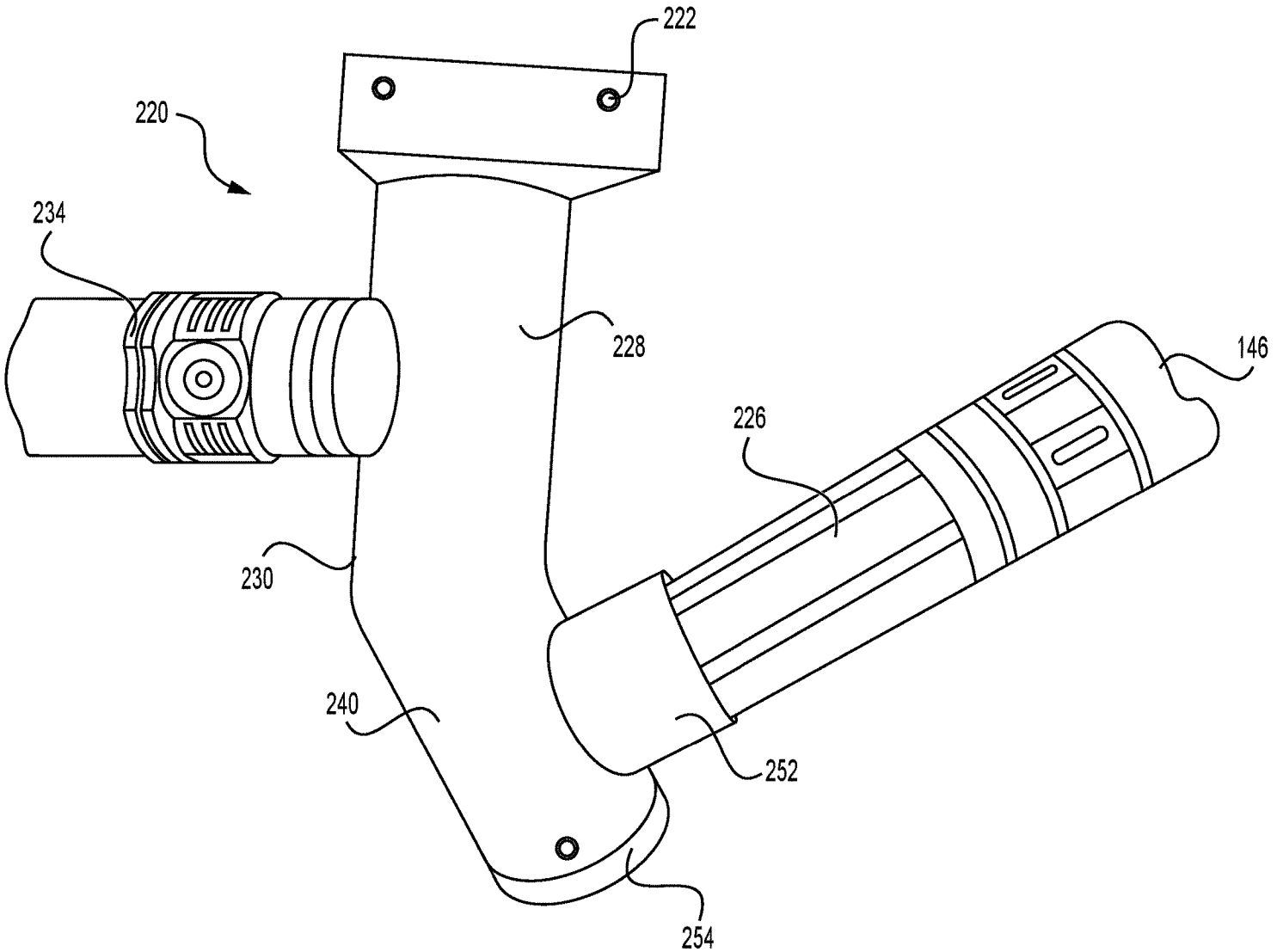
FIG. 4 shows a side view of the third angled support grip, in accordance with an aspect of the present disclosure.

FIGS. 3-4 each show of a third angled support grip 220 of the present disclosure. The third angled support grip 220 may be similar or identical to the second angled support grip 120, except for a few differences described herein.

The third angled support grip 220 includes a third upper portion 222 configured to attach to the frame 14 of the rifle 10, beneath the barrel 12 and forward of a trigger guard. The third angled support grip 220 also includes a third angled handle 226 having a cylindrical shape that extends at a 30-degree angle to an upper surface of the third upper portion 222.

Thus, the third angled handle 226 may define the same 30-degree angle to the barrel 12 of the rifle 10. The third angled support grip 220 also includes a third forward support 228 that extends downward from an end of the third upper portion 222 in a straight line perpendicular to the third upper portion 222. The third angled handle 226 also functions as a flashlight body holding batteries, a switch, etc. The third angled handle 226 may be formed from a flashlight body that is separately available as part of a flashlight assembly.

The third angled handle 226 extends upward and rearward from an end of the third forward support 228. The third angled support grip 220 includes a second angled extension 240 that extends downward and rearward at an 150-degree angle from the end of the third forward support 228 opposite from the third upper portion 222. The third angled handle 226 extends perpendicularly from the second angled extension 240 and adjacent to an end thereof opposite from the third forward support 228.

Each of the third forward support 228, the second angled extension 240, and the third angled handle 226 may be made of a metal material, such as tubular pieces of metal. For example, each of the third forward support 228, the second angled extension 240, and the third angled handle 226 may be made of Aluminum.

The third forward support 228 of the third angled support grip 220 defines a third forward face 230 that faces away from the third angled handle 226 and away from the user. The third forward face 230, therefore, faces toward a target direction of the firearm when the third angled support grip 220 is installed on the firearm. A second flashlight mount 232 is disposed on the third forward face 230 of the third forward support 228 of the third angled support grip 220, approximately mid-way between the third upper portion 222 and the second angled extension 240. The second flashlight mount 232 is configured to hold and to provide power to a second flashlight head 234 having one or more illumination sources, such as LEDs.

The second flashlight mount 232 may include first external threads (i.e., male threads) configured to engage corresponding first internal threads 236 of the second flashlight head 234. The second flashlight head 234 defines a lens and internal circuitry 238 that faces away from the third forward support 228 to project light toward a target when the third angled support grip 220 is mounted on a firearm.

The third angled handle 226 may also function as a flashlight body, with a tubular construction holding one or more batteries therein. The third angled handle 226 defines a second external thread 244 configured to screw into a second socket 242 on the second angled extension 240 having corresponding second internal threads. In some embodiments, the flashlight body that functions as the third angled handle 226 and the second flashlight head 234 may be parts of a commercially-available flashlight product. A second switch 246 is located on an end of the third angled handle 226 (i.e., the flashlight body) opposite from the second angled extension 240, and immediately below the thumb of a hand gripping the third angled handle 226. The second switch 246 may selectively enable the second flashlight head 234. In some embodiments, the second switch 246 may cycle between several different modes for operating one or more illumination sources in the second flashlight head 234.

The second flashlight head 234 may be selectively removable from the third angled support grip 220 and selectively attachable directly to the third angled handle 226 (i.e., without the third forward support 228 therebetween) to form a flashlight assembly (not shown in the FIGS.). For example, the second flashlight head 234 may screw onto each of the second flashlight mount 232 and the second external thread 244 of the third angled handle 226. Other connection mechanisms, such as a bayonet fitting, may be used instead of screw threads.

The third angled support grip 220 further includes a second electrical conductor 250, which may include one or more wires, for providing an electrical connection between the third angled handle 226 (i.e., the flashlight body) and the second flashlight head 234. In some embodiments, the second electrical conductor 250 may include a single wire, and the metal forming the third angled handle 226, the third forward support 228, and the second angled extension 240 may function as another conductor in an electrical circuit between the third angled handle 226 and the second flashlight head 234.

The third angled support grip 220 includes a socket extension 252 of metal tube that extends perpendicularly from the second angled extension 240 and which defines the second socket 242 for receiving the second external thread 244 of the fourth angled handle 226 for attaching the third angled handle 226 to the third forward support 228.

The third angled support grip 220 also includes an end cap 254 configured to plug an open end of the second angled extension 240, opposite from the third forward support 228. A pin 256 secures the end cap 254 on the open end of the second angled extension 240.

Figure 5:
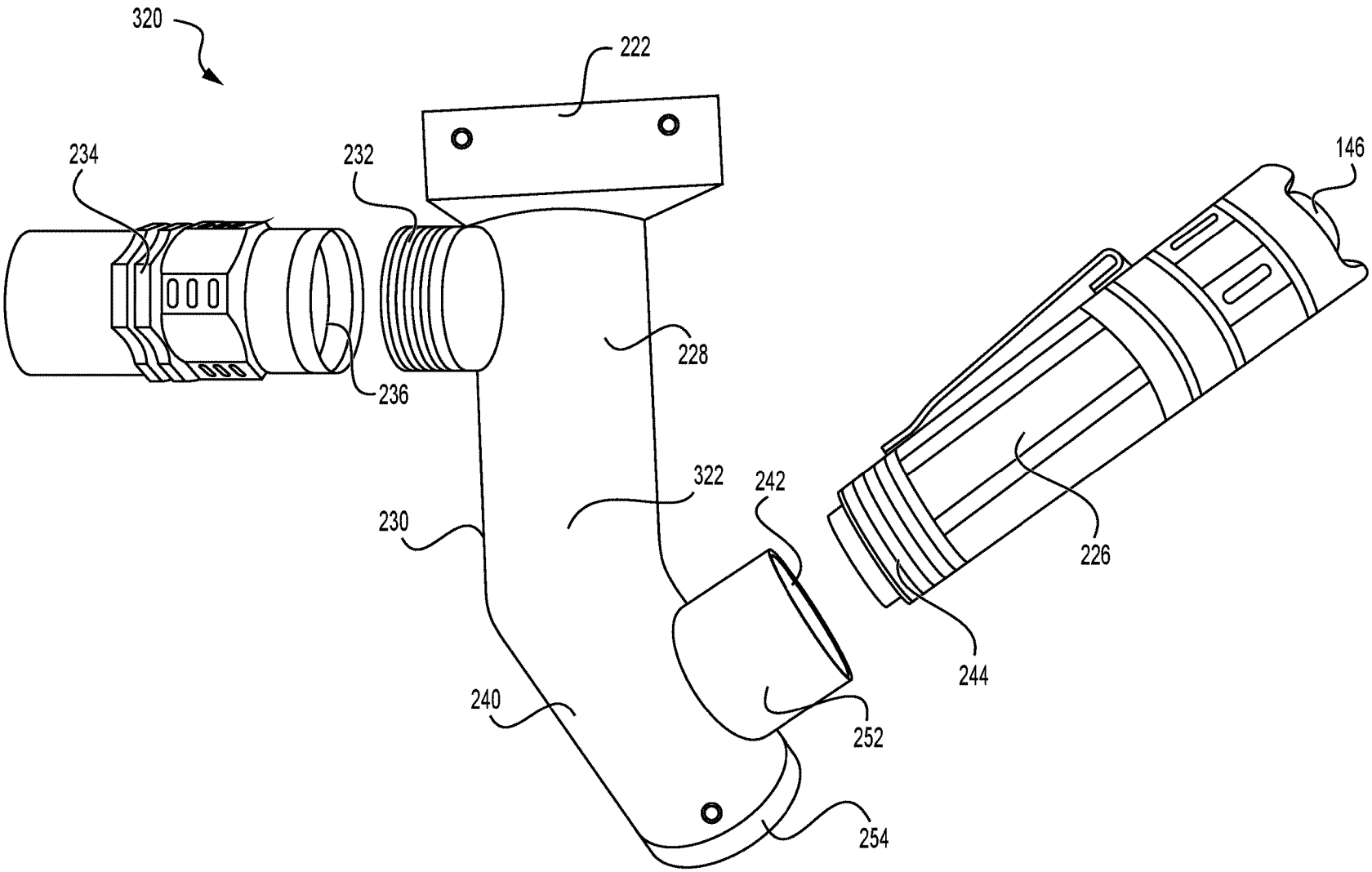
FIG. 5 shows a side view of a fourth angled support grip, in accordance with an aspect of the present disclosure.

FIG. 5 shows a side view of a fourth angled support grip 320 of the present disclosure. The fourth angled support grip 320 may be similar or identical to the third angled support grip 220, except for a few differences described herein.

The fourth angled support grip 320 includes the second flashlight mount 232 disposed on the third forward face 230 of the third forward support 228 adjacent to the third upper portion 222, providing a vertical grip region 322 of the third forward support 228. Alternatively, the second flashlight mount 232 may be disposed in a lower position, spaced apart from the third upper portion 222, such as on the second angled extension 240, providing the vertical grip region 322 of the third forward support 228 above the second flashlight mount 232.

The vertical grip region 322 may be gripped by a hand of the user in an alternative holding arrangement, i.e. with the non-trigger hand gripping the vertical grip region 322 instead of the third angled handle 226. This alternative holding arrangement may advantageous for some circumstances, such as for transporting the rifle 10 and/or for shooting from a seated or a prone position.

The angled support grip 20, 120, 220 of the present disclosure may form a C-shape including the upper portion 22, 122, 222, the forward support 28, 128, 228, and the angled handle 26, 126, 226. The second angled extension 240 also forms a part of the C-shape in the third angled support grip 220 and the third angled support grip 220. This C-shape may enable the subject angled support grip to provide enhanced stability and control of barrel lift, which may also be called barrel flip. More specifically, the C-shape of the angled support grip 20, 120, 220, 220 may function as a lever to counteract a tendency for the barrel 12 to lift and/or to counteract a clockwise force that can be produced when the rifle 10 discharges. For example, holding the third angled handle 226 of the third angled support grip 220 increases force on the C-shape combination of components, such as 222, 228, 240, thereby intensifying force applied to the second angled extension 240 and amplifying a force applied thereto to counteract the barrel flip and/or clockwise force that can be produced when the rifle 10 discharges.

Since the second angled extension 240 is the connection point to the third angled handle 226 at a lower end of the third angled support grip 220, this reverses the force on the C-shape. In other words, the third angled handle 226 can force the second angled extension 240 forward and down in a counter-clockwise motion by pulling down with fingers and pushing up with a thumb gripping the third angled handle 226. The third angled handle 226 may therefore function like a pry bar in response to the user rotating the wrist of a hand gripping the third angled handle 226 slightly forward. Theoretically, lengthening the third angled handle 226 would cause a corresponding increase in force generated by the force pushing up on it, for example by upward force applied by the thumb of the user gripping the third angled handle 226.

Furthermore, the second angled extension 240 may position the third angled handle 226 at a desired position that is between 0-degrees (i.e. parallel) and 50-degrees relative to the barrel 12. Positioning of the third angled handle 226 at an angle between 0-degrees and 50-degrees has been found to provide advantages for controlling barrel flip and clockwise forces generated by firing the rifle 10.

The second angled extension 240 may have characteristics, such as a length and/or angle relative to the third forward support 228 to provide a desired angle and position that is ergonomically correct to be gripped by the non-shooting hand of a user. An important feature of the C-shape with the angled handle 26, 126, 226 (such as the third angled handle 226) attached to the lower end of the forward support 28, 128, 228, is that those components function together as a lever to amplify force resisting barrel flip. This effect is so strong that barrel flip is dramatically reduced without the top of the handle the angled handle 26, 126, 226 being connected (e.g. as is the case in the embodiments of FIGS. 2-5. In the first angled support grip 20 shown in FIG. 1, both ends of the angled handle 26 are connected. However, the second angled support grip 120, the third angled support grip 220, and the fourth angled support grip 320, shown in FIGS. 2-5 (i.e. those having a C-shaped configuration without an upper end of the angled handle 126, 226 being directly connected to the upper portion 122, 222) may provide additional leverage. Thus, the C-shaped configuration of the second angled support grip 120, the third angled support grip 220, and the fourth angled support grip 320 may be especially effective at controlling barrel flip.

The foregoing description is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An angled support grip for a firearm having a frame, a trigger guard, and a barrel, the angled support grip comprising:

an upper portion configured to attach to the frame of the firearm beneath the barrel and forward of the trigger guard;

a forward support extending downward from an end of the upper portion opposite from the trigger guard; and an angled handle configured to be gripped by a hand of a user and attached to the forward support at a lower end thereof, opposite from the upper portion, the angled handle defining a central axis that extends away from the forward support in a substantially straight line upward and rearward toward the upper portion for positioning the hand gripping the angled handle in an orientation angled upward and rearward from the lower end of the forward support, wherein the forward support extends substantially perpendicular to the upper portion, and wherein the upper portion, the forward support, and the angled handle together define a c-shaped lever configured to counteract barrel flip generated when the firearm is fired.

2. The angled support grip of claim 1, wherein the upper portion further comprises a Picatinny rail mount configured to engage a corresponding Picatinny rail on the frame of the firearm.

3. The angled support grip of claim 1, wherein the angled handle is cylindrical.

4. The angled support grip of claim 1, wherein the angled handle extends at a substantially 30-degree angle to an upper surface of the upper portion.

5. The angled support grip of claim 1, further comprising an illumination source attached to the forward support.

6. The angled support grip of claim 5, further comprising a switch located on an end of the angled handle and configured to be actuated by a thumb of the hand gripping the angled handle; and wherein the switch is configured to selectively enable the illumination source or to cycle between several different modes for operating the illumination source.

7. The angled support grip of claim 1, further comprising an angled extension extending downward and rearward from an end of the forward support, opposite from the upper portion; and wherein the angled handle extends substantially perpendicularly from the angled extension and adjacent to an end thereof opposite from the forward support.

8. The angled support grip of claim 7, wherein each of the forward support, the angled extension, and the angled handle are made from tubular pieces of metal.

9. The angled support grip of claim 7, wherein each of the forward support, the angled extension, and the angled handle are made of aluminum.

10. The angled support grip of claim 1, further comprising an angled extension extending downward and rearward from an end of the forward support, opposite from the upper portion;

wherein the angled handle is attached to the angled extension; and wherein the angled handle extends upward and rearward toward the upper portion along a length thereof away from the angled extension.

11. The angled support grip of claim 10, further comprising:

one or more illumination sources; and a switch located on an end of the angled handle and configured to be actuated by a thumb of the hand gripping the angled handle; and wherein the switch is configured to selectively enable the one or more illumination sources or to cycle between several different modes for operating the one or more illumination sources.

12. The angled support grip of claim 10, further comprising a socket extension of metal tube extending substantially perpendicularly from the angled extension and defining a socket for attaching the angled handle to the angled extension.

13. The angled support grip of claim 1, further comprising a flashlight head having one or more illumination sources and attached to a forward face of the forward support to project light toward a target.

14. The angled support grip of claim 13, further comprising a flashlight mount including external threads disposed on the forward face of the forward support and configured to engage corresponding internal threads of the flashlight head.

15. The angled support grip of claim 14, wherein the flashlight mount is located adjacent to the upper portion, and the forward support defines a grip region configured to be gripped by the hand of the user.

16. The angled support grip of claim 14, wherein the flashlight mount is spaced apart from the upper portion, and the forward support defines a grip region between the upper portion and the flashlight mount and configured to be gripped by the hand of the user.

17. An angled support grip for a firearm having a frame, a trigger guard, and a barrel, the angled support grip comprising:

an upper portion configured to attach to the frame of the firearm beneath the barrel and forward of the trigger guard;

a forward support extending downward from an end of the upper portion opposite from the trigger guard;

an angled handle configured to be gripped by a hand of a user and attached to the forward support at a lower end thereof, opposite from the upper portion, the angled handle extending upward and rearward toward the upper portion along a length thereof away from the forward support;

a flashlight head having one or more illumination sources and attached to a forward face of the forward support to project light toward a target; and an angled extension extending downward and rearward from an end of the forward support, opposite from the upper portion, wherein the angled handle is attached to the angled extension;

wherein the angled handle extends upward and rearward toward the upper portion along a length thereof away from the angled extension;

wherein the angled handle is selectively removable from the angled extension and the flashlight head is selectively removable from the forward support; and wherein the angled handle is selectively attachable directly to the flashlight head to form a flashlight assembly.

18. An angled support grip for a firearm having a frame, a trigger guard, and a barrel, the angled support grip comprising:

an upper portion configured to attach to the frame of the firearm beneath the barrel and forward of the trigger guard;

a forward support extending downward from the upper portion, away from the barrel;

an angled handle configured to be gripped by a hand of a user and attached to the forward support at a lower end thereof, opposite from the upper portion, the angled handle extending upward and rearward toward the trigger guard along a length thereof away from the forward support; and a flashlight head having one or more illumination sources and attached to a forward face of the forward support to project light toward a target;

wherein the angled handle is selectively removable from the forward support and the flashlight head is selectively removable from the forward support; and wherein the angled handle is selectively attachable directly to the flashlight head to form a flashlight assembly.

* * * * *